United States Patent [19]

Koca

[11] Patent Number: 4,735,419

[45] Date of Patent: Apr. 5, 1988

[54] WORD AND DIE GAME

[76] Inventor: Richard L. Koca, 15099 E. Wagontrail Pl., Aurora, Colo. 80015

[21] Appl. No.: 915,785

[22] Filed: Oct. 6, 1986

[51] Int. Cl.[4] ..... A63F 1/04

[52] U.S. Cl. ..... 273/292; 273/146

[58] Field of Search ..... 273/146, 272, 292, 299

[56] References Cited

U.S. PATENT DOCUMENTS

| | | | |
|---|---|---|---|
| 1,377,327 | 5/1921 | Ebert | 273/299 |
| 3,208,754 | 9/1965 | Sieve | 273/146 |
| 4,055,348 | 10/1977 | Marzoni | 273/146 |
| 4,421,315 | 12/1983 | Cutler | 273/268 |
| 4,635,939 | 1/1987 | Makow | 273/296 |

FOREIGN PATENT DOCUMENTS

| | | | |
|---|---|---|---|
| 1274397 | 5/1972 | United Kingdom | 273/272 |

*Primary Examiner*—Anton O. Oechsle

*Attorney, Agent, or Firm*—Henderson & Sturm

[57] ABSTRACT

A word game in which words are made up from three-letter combinations contained as indicia on a medium supply, such as a deck of cards in which the indicia include columns of numbers with interspaced columns of letter combinations. A roll of a die determines according to the numerical value reflected by the die, which numbered letter combination is to be used in forming a word containing the three letters, specifically in the order in which the letters appear in the column but not necessarily consecutively. A second supply of cards is provided. These are challenge cards of two types, one challenging the existence of the word and the other the spelling of the word. These are used by players other than the caster of the die. Various arrangements of points are awarded and/or subtracted according to the roll of the die, challenges that fail or succeed, etc.

2 Claims, 1 Drawing Sheet

Fig. 1
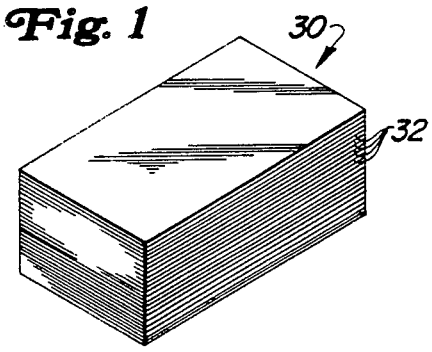
34 38 34 36 34 36
| | | | | | |
|---|---|---|---|---|---|
| 1. | HTE | 8. | IPN | 15. | FES |
| 2. | GNA | 9. | 333 | 16. | 111 |
| 3. | 222 | 10. | BOO | 17. | HAV |
| 4. | JOR | 11. | KIE | 18. | LEG |
| 5. | SCL | 12. | RCT | 19. | QTI |
| 6. | ALN | 13. | DSN | 20. | CRR |
| 7. | ESI | 14. | 444 | | WEO |
40
36 32
Fig. 2
4,735,419
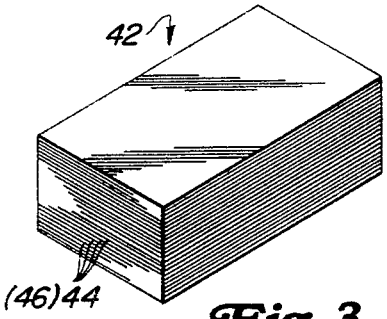
Fig. 3
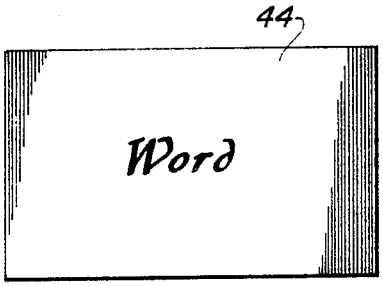
Fig. 4
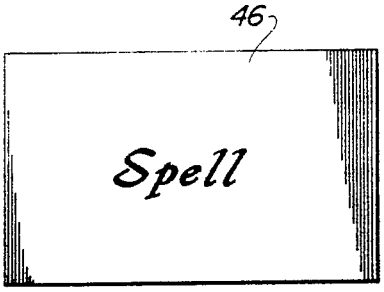
Fig. 5
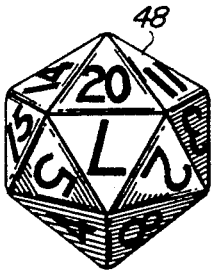
Fig. 6

WORD AND DIE GAME

BACKGROUND AND SUMMARY

Various forms of word games have been in existence over the past many years, perhaps the most famous of which being that known as "Scrabble", on which there have been many variations. However, so far as is presently known, none combines the elements presented in the game of the instant invention, in which the roll of a single die indicates a numbered combination of letters that must be successfully used by the player in spelling a word in order to score points. In a preferred form of the invention, a deck or supply of word cards is provided in which each card has indicia including a plurality of numbered indicator columns of numerals interspaced with columns of letter combinations respectively alined with the numerals. Among the letter combinations are number combinations. A roll of a single die produces a result which, when compared with an indicator numeral in a column, yields the letter or number combination to be used. In the case of a number combination, points may be scored or subtracted or the number may lead to other results. It is a feature to provide a plurality of such cards in order to create a substantial number of letter combinations. The number combinations have nothing to do with the corresponding number on the die. The number combinations are: "111", "222", "333", and "444". It is impossible to roll these combinations with a single die. A second deck of cards, comprising challenge cards, can be used by players who contest the validity of the word announced by the owner of the die. There are two types of challenge cards: one that challenges the existence of the word and the other that challenges the spelling of the word. The rules may provide for the scoring or subtraction of points according to the success or failure of the challenge. Along with the cards is a single die, which in a preferred form of the invention, has twenty sides bearing numerals one through twenty.

The foregoing and other features of the invention will become apparent as a disclosure of a preferred embodiment thereof progresses in conjunction with the accompanying drawing.

DESCRIPTION OF THE DRAWINGS

FIG. 1 is a perspective of the deck or supply of number/letter cards.

FIG. 2 is a face view of a representative number/letter card.

FIG. 3 is a perspective of a deck or supply of challenge cards.

FIG. 4 is a face view of a representative "word" challenge card.

FIG. 5 is a face view of a representative "spell" challenge card.

FIG. 6 is a view of a die used in the game.

DETAILED DESCRIPTION OF A PREFERRED EMBODIMENT OF THE INVENTION

A first supply or deck (30) of cards (32) is shown in FIGS. 1 and 2 in which the cards may be of a size comparable to typical playing cards, or may be common 3"×5" cards, which dimensions are a matter of detail. There may be a plurality of cards (32), say sixty, which again is a matter of choice. The cards are all different as to letter combinations, as will be explained, but are identical in format so far as concerns general arrangement of indicia in columns, best depicted in FIG. 2 which shows a representative card (32).

The indicia on each card (32) includes a plurality of side-by-side, parallel, spaced apart columns (34) collectively including numeral designations. In the present case, there are three such columns and these are numbered one through twenty in sequential order, seven designations per column except the third column which ends with the number twenty, for reasons to presently appear. The spaced-apart relationship of the columns (34) provides a plurality of columns (36) interspaced with the columns (34), and these include further indicia in the form of several leter combinations (38) and a few interspersed number combinations (40). These combinations are respectively horizontally alined with the numbers in the columns (34). In the present case, each letter combination is different from all others in the deck so as to afford the greatest number of combinations in a conveniently-sized deck; although, as will be clear, fewer or more cards and other and shorter or longer letter combinations may be provided. In the preferred instance selected as the basis of the instant disclosure, each letter combination comprises a three-letter group and each number combination comprising a three-digit group. As seen in FIG. 2, there are, in the first column, at "Position 1", a three-letter group consisting of the letters "HTE", followed at number 2 by "GNA", followed at number 3 by a numbers group "222". As stated, the letter groups are all different. The other number groups are "111", "333" and "444". The significance of this arrangement is set forth below.

The letter groups are selected on the basis of their respective abilities to appear, in their respective sequences, in commonly known words, in this case with other letters (independent of the card groups) intervening. For example, the letters "GNA" appear in the word "general", which contains the leters "g", "n" and "a" in the letter group order but not immediately adjacent to each other. Other examples will readily occur to the reader without further detailed explanation. The purpose of the number combinations or groups is to establish a basis for scoring, penalties, etc. All this will be elaborated upon with an explanation of playing the game according to presently preferred rules.

The game includes a second supply or deck (42) (FIG. 3) comprising two sets of cards (44) and (46). Both sets of cards are "challenge" cards, the set (44) being used to challenge the existence of a word (FIG. 4) and the cards in the set (46) being used to challenge the spelling of a word (FIG. 5). Challenges are issued by players in opposition to the player naming a word based on his use of letters in a letter group (38). If desired, the two sets of challenge cards could be used as separate decks. In the present case, the "word" and "spell" cards are shuffled together and placed face down on the table or other playing surface. The letter-number deck (30) is also placed face down.

The game, according to the present disclosure of a preferred embodiment, is completed (except for whatever scoring media are chosen) by a die (48) (FIG. 6), preferably having twenty sides, numbered one through twenty.

The basis of the game is that the roll of the die determines the use of a letter or number combination from the cards in the deck (30), which, as said before, is placed face down on the table or other playing surface. The highest number on the die is twenty, which explains why the numbers on the letter/number cards (32) stop at the number twenty. All this could be varied by more dice, elimination of certain numbers on the die, etc., all without materially altering the basic invention. The present arrangement has been tried and found to be amusing, successful, etc.

In any event, the player to go first is selected by lot, for example, and he rolls the die which, when coming to rest, will present a numeral which is compared with the corresponding number in the number columns (34) of the card (32), which may be drawn before or after the die is rolled. For example, suppose the die shows the numeral eight. If the card (32) selected is that shown in FIG. 2, it is seen that the letter group alined with the number 8 is "IPN", which may be used, for example, to make up, among others, the word "important". If not challenged or if challenged and the challenge is successfully met, the player is awarded a certain number of points against a selected number chosen as the minimum required to win the game. Special awards or penalties may result if the number on the die dictates a number combination on the card. Currently "111" equals Lost Turn; "222" equals Double Bonus; "333" equals Triple Bonus; "444" equals Free Challenge Card. Looking at the sample card (32) from FIG. 2, it is seen that the number group "222" appears next to the designating numeral 3. In that case, the rules may provide that the player must select the next following or next preceding letter group and form a work from that. In the present example, the next following letter group is "JOR". Alternatively, the player may be awarded points, penalized, etc.

If a player other than the one presenting the word questions the word as to existence or spelling, he may draw a top card from the challenge deck (42) (FIG. 3). Whether or not he is entitled to draw such card may depend upon whatever rules are in force. For example, it may be provided that a challenge card must be "purchased" by points previously scored by the challenger. Or points may be debited against his future scoring. Or free challenges may be allowed early in the game. If the player presenting the word fails to meet the challenge by dictionary-showing of the word and/or its spelling, he may be penalized, the challenger rewarded, or any other arrangement. The rules may provide a time limit for the player who has rolled the die to present a word. He may be required to announce the word and then spell it. Extra points may be awarded for words containing over a certain number of letters. After a card from the deck (30) is used, it is placed face down at the bottom of the deck. Different rules may be provided for the challenge cards; for example, if awarded as a bonus and not used immediately, it may be kept, used or sold later to another player. The same challenged card, however, may be used but once.

The game has proved interesting, amusing and stimulating. Although only a preferred embodiment is disclosed, it will be understood that many modifications and additions, etc. may be made without departure from the spirit and scope of the invention.

I claim:

1. A word game comprising a supply of cards, each card bearing a first set of indicia including a plurality of columns of numerals, the columns being arranged in parallel side-by-side relation and providing spaces between them, the numerals being arranged in sequential order, each card further bearing a second set of indicia including leter combinations arranged in the spaces and respectively in horizontal alinement with the numerals, each combination of letters including at least two letters based on actual words, die means marked to denote numerical values, the die means being cast to present a numerical value to be used in selecting the corresponding numeral and alined letter combination on a card drawn from the supply, which leter combination is used to spell a word that includes the combination, and said second set of indicia including, among the letter combinations, preselected number combinations which, if dictated by the numerical value indicated by the die means, are used in the game scoring.

2. The word game of claim 1, in which each letter combination comprises three letters of the alphabet, and each number combination includes a set of three like numerals, the sets of such numerals differing from each other.

* * * * *